US005099228A

United States Patent [19]

Israel et al.

[11] Patent Number: 5,099,228

[45] Date of Patent: * Mar. 24, 1992

[54] ELECTRONIC ANTI-THEFT MERCHANDISE TAG HAVING MEANS FOR ACTIVATING AN ALARM IN RESPONSE TO AN ATTEMPT TO REMOVE THE TAG FROM THE MERCHANDISE

[75] Inventors: Marcia Israel, 15802 Arminta St., Van Nuys, Calif. 91406; Leo R. Close, Sepulveda, Calif.

[73] Assignee: Marcia Israel, Van Nuys, Calif.

[ * ] Notice: The portion of the term of this patent subsequent to Oct. 9, 2007 has been disclaimed.

[21] Appl. No.: 483,114

[22] Filed: Feb. 21, 1990

Related U.S. Application Data

[63] Continuation-in-part of Ser. No. 308,771, Feb. 9, 1989, Pat. No. 4,962,369.

[51] Int. Cl.[5] ..... G08B 13/24

[52] U.S. Cl. ..... 340/572; 340/539; 340/693

[58] Field of Search ..... 340/572, 539, 568, 693

[56] References Cited

U.S. PATENT DOCUMENTS

| | | | |
|---|---|---|---|
| 3,911,534 | 10/1975 | Markers et al. | 340/572 |
| 3,973,418 | 8/1976 | Close | 70/34 |
| 4,134,108 | 1/1979 | Palmer et al. | 455/31 |
| 4,565,996 | 1/1986 | Close | 340/554 |
| 4,595,915 | 6/1986 | Close | 340/554 |
| 4,620,182 | 10/1986 | Keifer | 340/568 |
| 4,962,369 | 10/1990 | Close | 340/539 |

*Primary Examiner*—Glen R. Swann, III

*Attorney, Agent, or Firm*—Spensley Horn Jubas & Lubitz

[57] ABSTRACT

A security tag, attachable to an article of merchandise by means of a tack received by the tag, includes means for sensing the presence of the head of the tack. The sensing means causes activation of an alarm circuit in response to displacement of the tack head relative to the tag resulting, for example, from an unauthorized attempt to withdraw the tack from the tag, or severance of the tack head. The tack may be coupled to the tag by means of a length of coaxial cable which may be used to attach the tag to an article to be safeguarded. The cable includes a pair of conductors normally insulated from each other. Contact between the conductors caused, for example, by an attempt to cut the cable, results in activation of the alarm circuit.

20 Claims, 5 Drawing Sheets

ELECTRONIC ANTI-THEFT MERCHANDISE TAG HAVING MEANS FOR ACTIVATING AN ALARM IN RESPONSE TO AN ATTEMPT TO REMOVE THE TAG FROM THE MERCHANDISE

CROSS REFERENCE TO RELATED APPLICATION

This application is a continuation-in-part of application Ser. No. 308,771 filed Feb. 9, 1989, for "Merchandise Security System Utilizing RF Transmitter" and owned by the assignee of the present application, now U.S. Pat. No. 4,962,369.

FIELD OF THE INVENTION

The invention relates generally to electronic security and anti-theft systems for protecting retail store merchandise and the like, and particularly to improvements in the monitoring tags used in such systems.

BACKGROUND OF THE INVENTION

Various electronic security systems are available for monitoring merchandise and discouraging theft from retail establishments such as clothing stores. One system in widespread use employs a transmitter for radiating a radio frequency field throughout a surveillance zone near the store exit. An electronic monitoring tag, enclosing circuitry tuned to the transmitted signal frequency, is attached to each garment and if an attempt is made to carry a protected garment through the surveillance zone, the circuitry re-radiates the transmitted signal at a second frequency, the re-radiated signal being detected by a receiver which activates an alarm.

The monitoring tag used in these existing systems is secured to a garment by means of a tack having a pointed shank which is passed through the garment and into the tag housing where it is received by a one-way fastener which resists withdrawal of the tack. Although piercing the garment with the tack occasionally damages a garment, tacktype tags are preferred by many retail clothing establishments because they are available as compact, inexpensive units. Moreover, they can be made so that the tack is reusable, as disclosed, for example, in U.S. Pat. Nos. 3,911,534 (magnetic tack release) and 3,973,418 (mechanical release).

However, as already mentioned, existing tack tag systems typically rely on exit monitoring systems. Accordingly, if a pilferer succeeds in prying the tack out of the tag or severing the head of the tack, the garment sometimes can be removed from the store without detection. To now, this problem has not been adequately addressed.

Moreover, it would be desirable to use tack-type tags to safeguard displayed merchandise other than garments, for example, electronic goods or hand tools.

SUMMARY OF THE INVENTION

Broadly, there is provided a security tag having means for sensing the presence of the head of the tack. The sensing means causes alarm activation in response to displacement of the tack head relative to the tag, caused, for example, by an unauthorized attempt to withdraw the tack from the tag, or severance of the tack head.

In accordance with one specific, exemplary form of the invention, the tag includes a housing, an electrical circuit enclosed within the housing for activating an alarm and a power supply within the housing for energizing the alarm-activating circuit. A switch inside the housing, operable by means projecting from the housing, controls energization of the alarm-activating circuit by the power supply. The switch-operating means is positioned so as to be depressed by the head of the tack when the tack shank is inserted into the housing. Displacement of the tack head relative to the tag as a result of an unauthorized attempt to withdraw the tack or sever the tack head releases the switch-operating means thereby changing the state of the switch and energizing the alarm-activating circuit. The tack may be released from the tag without activating the alarm by means of an authorized removal fixture located, for example, at a checkout counter.

The foregoing security tag may be combined with a cable having one end anchored to the head of the tack and another end affixed to the housing. A closed loop may thereby be formed for attaching the tag to an article such as a hand tool or a piece of electronic equipment having a handle or the like. The cable includes a pair of conductors normally insulated from each other and connected across the abovementioned switch. An attempt to cut the cable will cause the conductors to make contact with each other thereby energizing the alarm-activating circuit.

BRIEF DESCRIPTION OF THE DRAWINGS

The foregoing and other objects, features and advantages of the invention will be apparent from the detailed description below read in conjunction with the accompanying drawings in which.

DETAILED DESCRIPTION OF THE INVENTION

Figure 1:
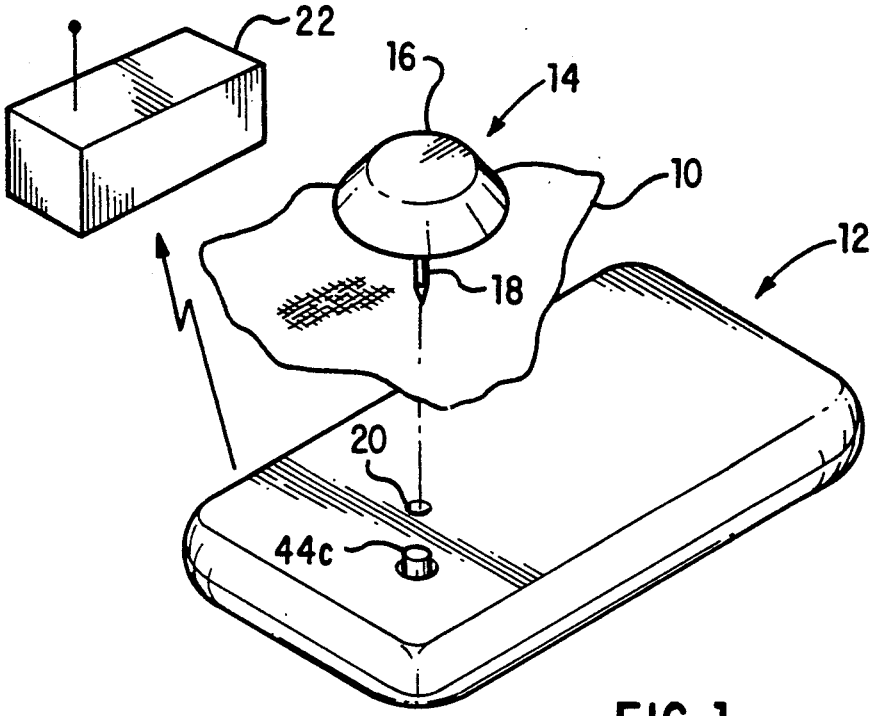
FIG. 1 is a perspective view of the basic components of a merchandise security system employing the principles of the invention.

With reference to FIG. 1, there is shown in diagrammatic form the main components of a security system in accordance with a preferred embodiment of the invention for protecting retail merchandise such as a garment 10 a portion of which is shown in the drawing. The system includes a security tag 12 adapted to be attached to the garment by means of a tack 14 having an enlarged head 16 and a pointed shank 18. The shank is passed through the garment 10 and inserted into an opening 20 in the upper surface of the tag. As will be presently explained in greater detail, tampering with the tack 14 energizes a radio frequency transmitter carried by the tag. The resulting RF field generated by the tag is detected by a receiver 22 which activates an alarm. It will be obvious to those skilled in the art that the tag may also incorporate rebroadcast circuitry so that the tag may be used with existing exit monitoring systems such as those disclosed in U.S. Pat. Nos. 4,565,996 and 4,595,915.

Details of the tag structure and electrical circuitry are shown in FIGS. 2–5. The tag includes a housing 30 comprising upper and lower portions 30*a* and 30*b* joined along their peripheries. Mounted within the housing 30 is a printed circuit board (PCB) 32 carrying various electronic components which, except for a battery 34 and a transmitter disabling switch 36, are not shown in FIGS. 2–4A for the sake of simplicity. Also mounted inside the housing are a tack fastener 40, a normally open microswitch 42 and a tack-sensing cam element 44 for operating the microswitch.

Figure 2:
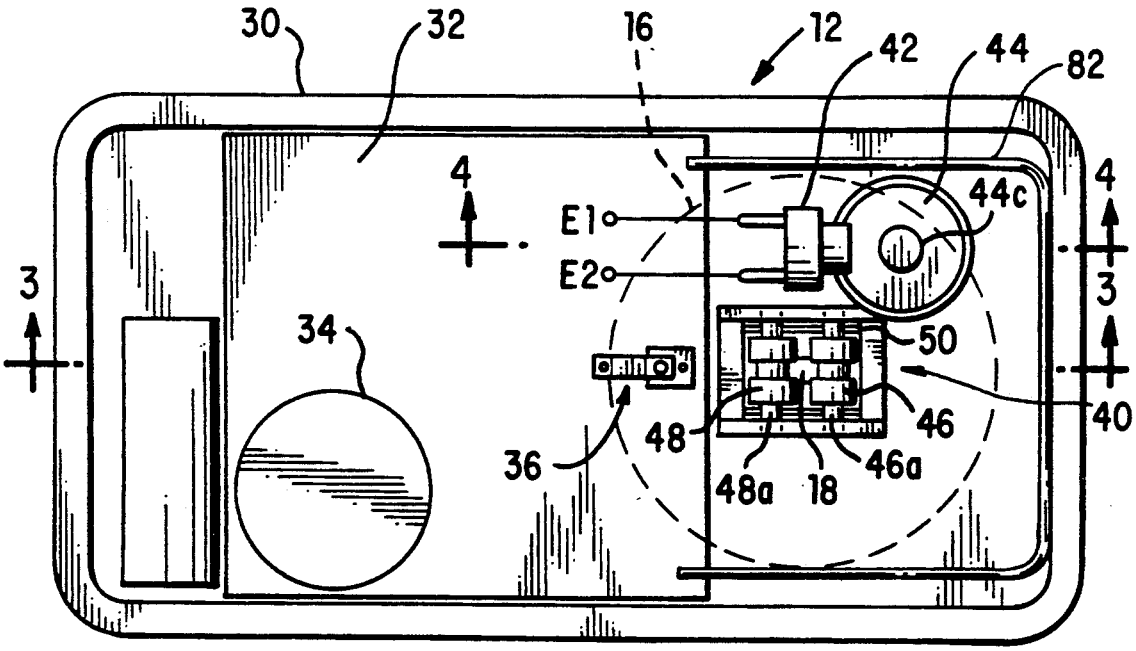
FIG. 2 is a top plan view of a tag in accordance with the invention, with the upper portion of the tag housing removed.
Figure 3:
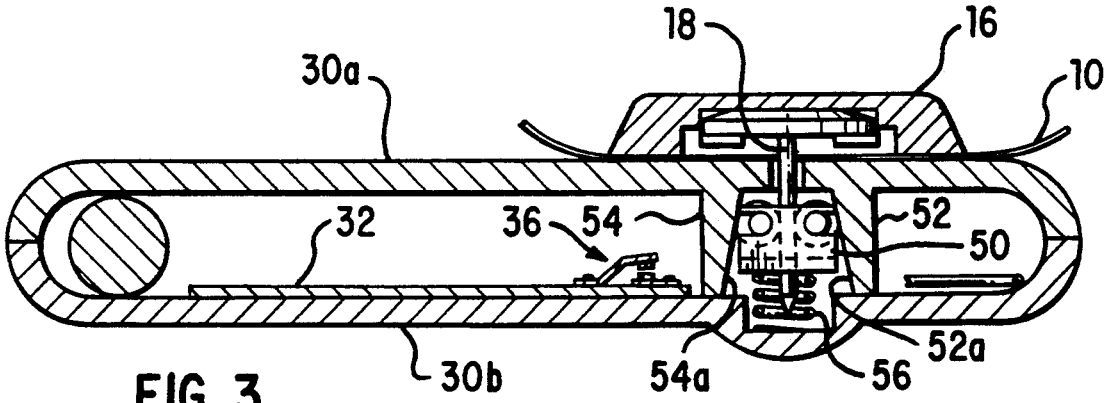
FIGS. 3 and 3A are side elevation views, in section, of the tag of FIG. 2 as seen along the plane 3—3.

The tack fastener 40 includes a pair of parallel, grooved, transversely oriented rollers 46 and 48 supported by a roller carrier 50. The rollers include end-stubs, such as 46*a* and 48*a*, riding in longitudinally extending slots, such as the slots 50*a* and 50*b*, formed in the sides of the carrier 50. The rollers cooperate with abutments 52 and 54 forming part of the upper housing portion 30*a*, the abutments having inside walls 52*a* and 54*a* which slope outwardly in a downward direction. The rollers 46 and 48 engage the sloping inside walls. A coil spring 56 compressed between the lower surface of the carrier 50 and the bottom of the lower housing portion 30*b* biases the roller carrier 50 upwardly thereby forcing the rollers toward each other. The rollers are positioned relative to the opening 20 in the tag housing so that the vertically oriented tack shank 18 is received between the rollers as best shown in FIGS. 2 and 3. It will be evident that the fastener 40 thereby provides a one-way locking action permitting easy insertion of the tack into the housing, but resisting withdrawal thereof once inserted. With the tack in place as shown in FIG. 2, the garment is firmly clamped between the tag housing and the enlarged tack head.

Figure 3A:
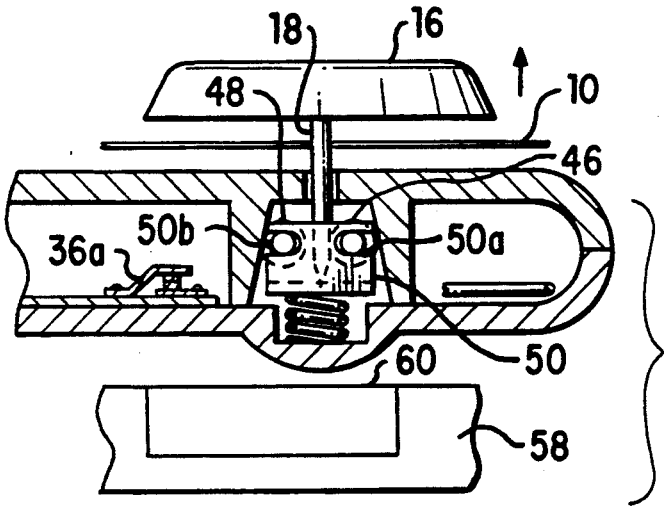

The roller carrier 50 is preferably made of a ferromagnetic material. Accordingly, as shown in FIG. 3A, when the tag is placed in a tack removal fixture 58 incorporating a strong magnet 60, the carrier 50 is attracted and drawn down by the magnet 60 thereby unlocking the rollers and freeing the tack shank so as to permit easy withdrawal of the tack. In this fashion, authorized removal of the tack is provided.

Figure 4:
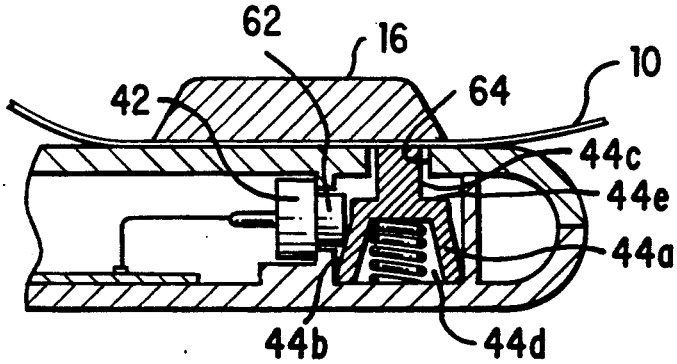
FIGS. 4 and 4A are side elevation views, in section, of a portion of the tag of FIG. 2 as seen along the plane 4—4.
Figure 4A:
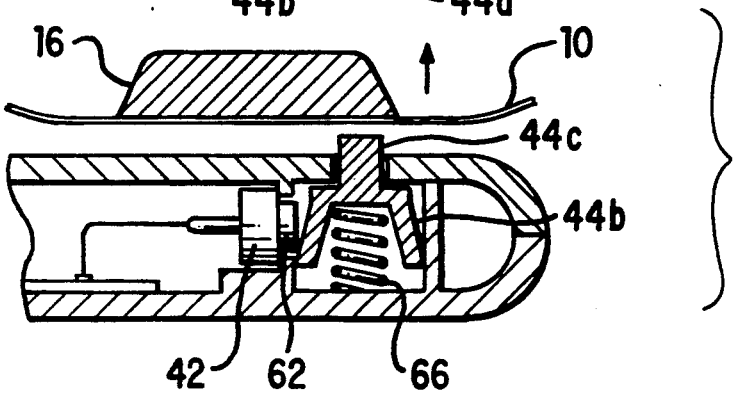

The microswitch 42 is mounted in the tag housing adjacent the fastener 40 and includes a microswitch actuator in the form of a plunger 62. The cam element 44 has a skirt 44*a* defining a flaring external cam surface 44*b* engaged by the microswitch actuator 62. The cam element 44 further includes an upwardly extending button 44*c* projecting through an opening 64 in the upper housing portion 30*a*. A compressed coil spring 66, one end of which is disposed within a well 44*d* defined by the skirt 44*a* and the other end of which bears against the bottom wall of the lower housing portion 30*b*, biases the cam element 44 upwardly so that with the tack withdrawn from the tag, the button 44*c* projects above the upper exterior surface of the tag (FIG. 4A) to the extent allowed by a shoulder 44*e* on the cam element which engages the upper wall of the upper housing portion. As best shown in FIGS. 2, 4 and 4A, the button 44*c* is positioned within the confines of the enlarged head 16 of the tack so as to be depressed thereby when the tack is substantially fully inserted in the tag (FIG. 4). With the cam element 44 thus in its lowermost position, the microswitch actuator 62 is extended and the switch 42 is open, while release of the cam element button 44*c* (FIG. 4A) (which may result from tampering with the tack) causes the cam surface 44*b* to push the actuator 62 in, thereby closing the switch. The switch 42 may, of course, be disposed within the tag housing so as to be directly operated by the tack head. However, the limited travel of the microswitch actuator might result in unreliable switch operation. Accordingly, the slope of the cam surface 44*b* is such that the vertical travel of the cam element 44 substantially exceeds the horizontal displacement of the actuator 62 required to operate the switch 42 between its "on" and "off" states.

Figure 5:
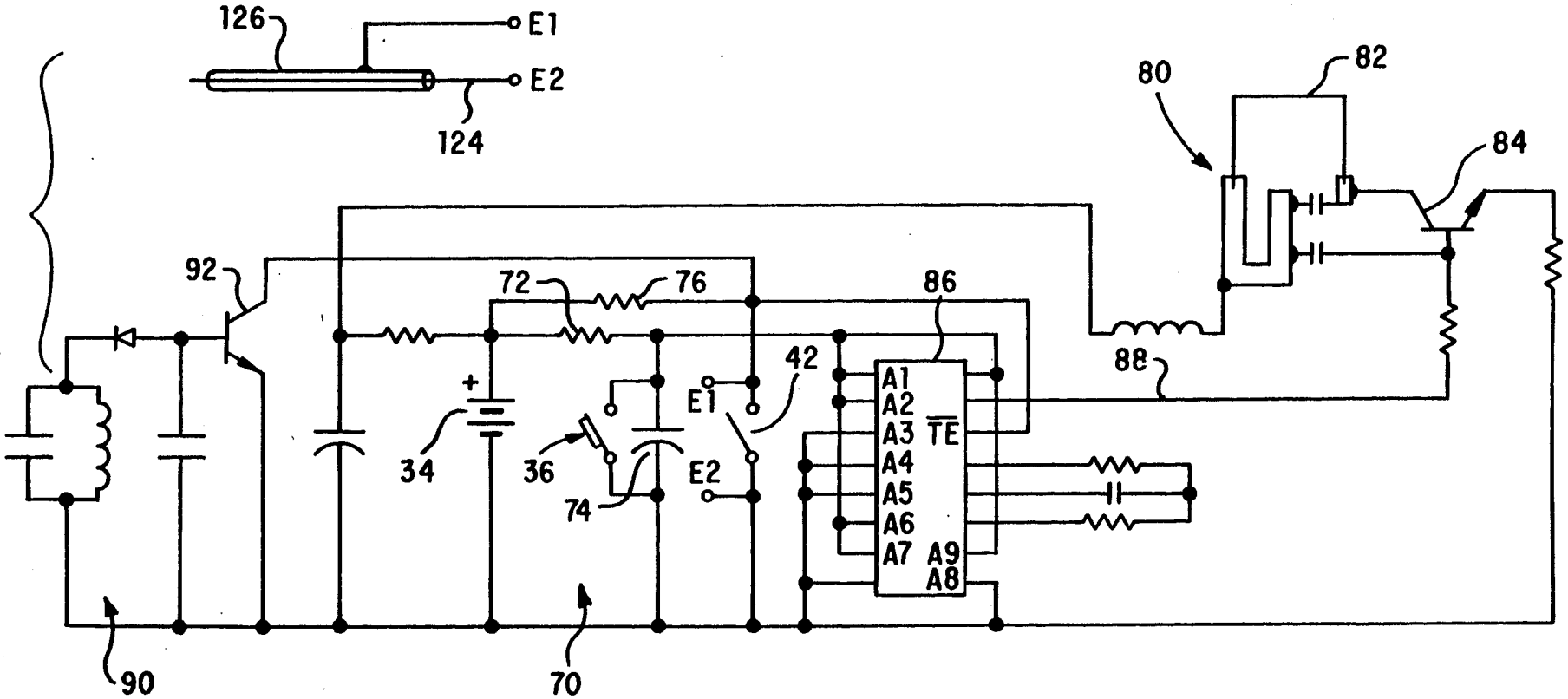
FIG. 5 is a schematic of the electrical circuitry enclosed within the tag.

With reference to FIG. 5, the tag circuit components, most of which are carried by the PCB 32, include a source of electrical energy, or power supply 70 comprising the battery 34, a resistor 72 and a capacitor 74. The disabling switch 36 is connected across the capacitor 74; with that switch open (as shown), the battery charges the capacitor through the resistor 72. The series combination of a pull-up resistor 76 and the microswitch 42 is connected across the battery 34.

The tag circuitry further has means for activating an alarm, including a radio frequency transmitter 80 having an antenna 82 and related inductive and capacitive oscillation-producing elements fed by the battery 34. A switching transistor 84, connected in series with the circuit of antenna 82, interrupts the RF signal radiated by the antenna in accordance with a coded modulation signal produced by an encoder 86 having an output line 88 connected to the base terminal of the transistor 84.

In accordance with a practical example of the invention, the encoder 86 is a Motorola MC145026 integrated circuit device. This device encodes nine bits of information applied to address terminals A1–A9, and serially transmits this information in the form of two nine-bit words along output line 88 upon receipt of an enable signal (active low) at pin $\overline{TE}$. When encoded with binary data, 512 different codes are available. As shown in FIG. 5, the inputs A1, A2, A6, A7 and A9 are held high (binary 1) while the remaining inputs are grounded (binary 0). It will be seen that when the microswitch 42 is closed, $\overline{TE}$ is brought low, thereby enabling the encoder 86 which, powered by the charge on the capacitor 74, transmits two nine-bit words to the base of the transistor 84 thereby interrupting or modulating the transmitter output accordingly.

The tag also encloses a tuned detection circuit 90 for detecting an RF field transmitted at a standard frequency, for example, 915 MHz, by an exit monitoring system or the like. The output of the detection circuit 90 is connected to the base of a transistor 92 having its collector coupled to the pin $\overline{TE}$ of the encoder 86 and its emitter grounded. In the presence of an RF field of the appropriate frequency, the voltage at the base of the transistor 92 rises turning the transistor 92 "on" thereby enabling the encoder 86 and the tag transmitter 80.

In its simplest form, the system requires only a single receiver 22; a receiver used to detect a re-broadcast signal of the typical transponder tag may be eliminated.

The tag transmitter disabling switch 36 is connected across the capacitor 74 and includes a movable, ferromagnetic contact 36*a* so that with the tag in the tack removal fixture 58 (FIG. 3A), the contact 36*a* is drawn down by the magnet 60 to close the switch 36 thereby discharging the capacitor 74 and preventing energization of the transmitter.

Figure 6:
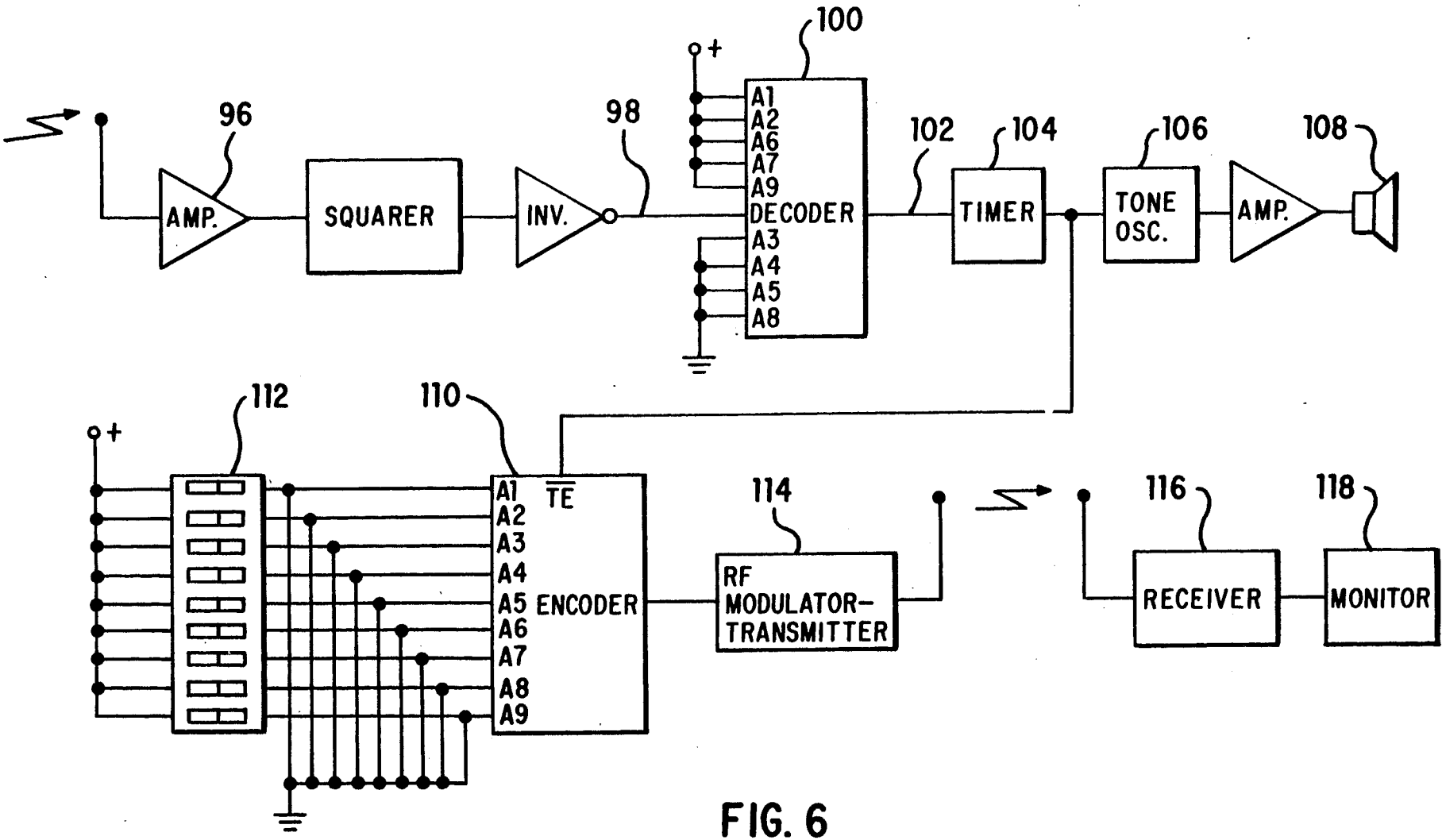
FIG. 6 is a block diagram of a receiver and alarm system employed in conjunction with the invention.

By way of example only, the following values may be used for certain of the components shown in FIG. 5:

Battery 34: 6 volts (lithium cells)
Resistor 72: 10 megohms
Resistor 76: 1 megohm
Capacitor 74: 10 microfarad The code-modulated RF signal transmitted by the tag is detected by the receiver 22, the main components of which are shown in block diagram form in FIG. 6. The received signal is amplified by an RF amplifier 96, squared, inverted and applied to an input terminal 98 of a decoder 100 which may be a Motorola MC145028 integrated circuit device. The address bits at the nine terminals A1–A9 of the decoder 100 match those of the encoder 86 and when the decoder receives that preselected bit pattern the decoder output 102 goes high. The decoder output starts an alarm timer 104 whose output is applied to tone oscillators 106 which drive a speaker 108 or other alarm device via an amplifier.

In accordance with an alternative arrangement also shown in FIG. 6, the system may be augmented to provide an identification of the specific area of the store from which an alarm originates. The output of the timer 104 is connected to the enable ($\overline{TE}$) terminal of an encoder 110 whose address terminals may be made high or low via a DIP switch 112, for example, and thereby coded to identify a particular store department such as ladies, apparel. The output of the encoder 110 is transmitted via an RF modulator/transmitter 114, to a receiver 116 which detects and decodes the transmitted signal and provides the information to a monitor 118 when a matching coded transmission is received.

Figure 7:
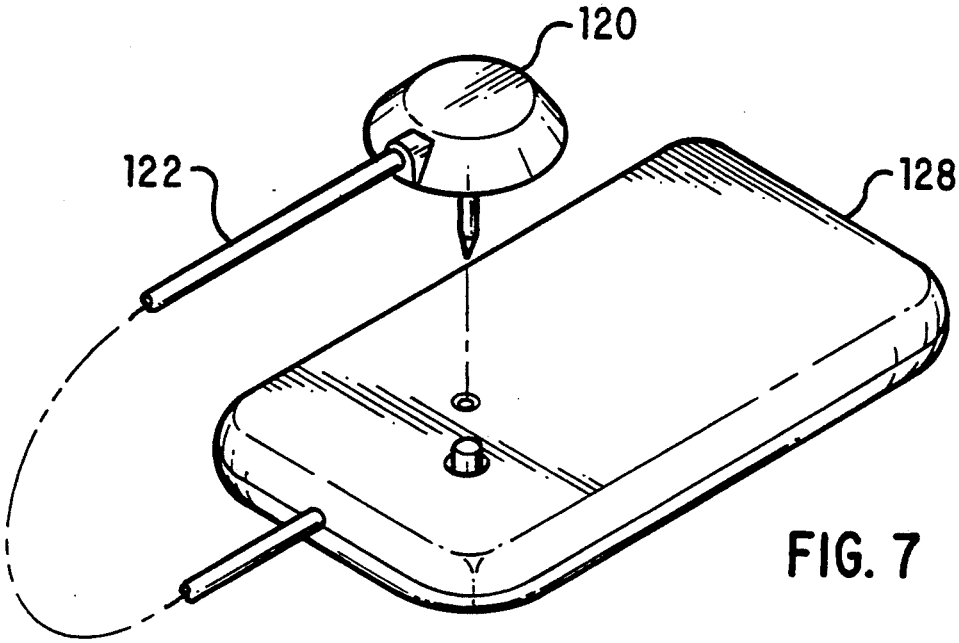
FIG. 7 is a perspective view of an alternative embodiment of the present invention.
Figure 8:
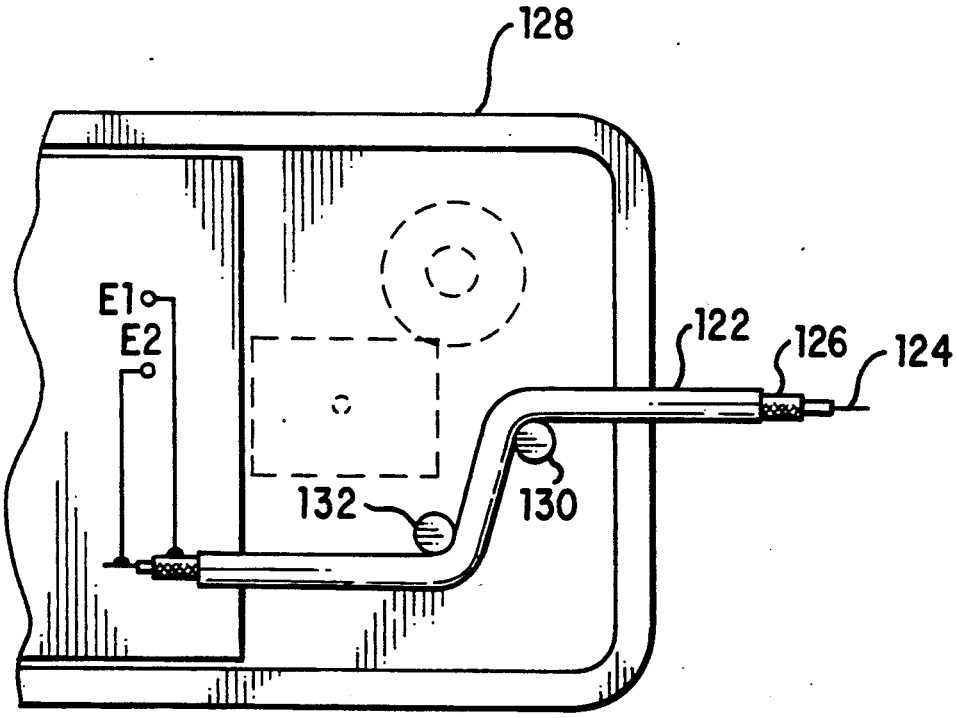
FIG. 8 is a somewhat simplified top plan view of a portion of the tag shown in FIG. 7 with the upper half of the housing removed.

Turning to FIGS. 7 and 8, there is shown a tag essentially as already described, but in which the tack head 120 is coupled to the tag by a length of standard coaxial cable 122. As is well known, cable of this kind includes a center conductor 124 surrounded by a conductive braided shield 126, the two conductors being insulated from each other. The cable 122 may be of any convenient length; for example, a six-inch cable may be used to protect display merchandise such as a hand tool. One end of the cable is firmly anchored in the tack head 120 while the other end is clamped between the upper and lower halves of tag housing 128 and secured by strain-relief posts 130, 132 inside the tag housing. The tag is attached to the article to be protected by passing the tack through a portion of the article such as a handle and then inserting the tack into the tag housing in the fashion already described.

Turning now also to FIG. 5, the inner ends of the cable conductors 124, 126 are connected to terminals E1 and E2 on the printed circuit board, that is, across the switch 42. An attempt to cut the cable causes the conductors 124, 126 to make contact with each other thereby grounding the enable pin $\overline{TE}$ of the encoder 86 and energizing the transmitter 80 in the manner already described.

What is claimed is:

1. A security tag comprising:

means operatively associated with said tag for attaching the tag to an article to be safeguarded;

a power supply enclosed within the tag, said power supply comprising a battery and a series combination of a capacitor and a resistor connected across the battery whereby the capacitor is charged by the battery through said resistor;

a radio frequency transmitter enclosed within the tag; and means carried by said tag and operable in response to an alarm condition for activating the transmitter utilizing the energy stored in said capacitor.

2. A security tag, as defined in claim 1, in which:

said alarm condition is produced as a result of tampering with said tag attaching means.

3. A security tag, as defined in claim 2, in which:

said transmitter includes an encoder controlling energization of the transmitter in accordance with a predetermined code, said encoder being powered by the energy stored in said capacitor.

4. A security tag for attachment to an article of merchandise, the tag comprising:

a housing;

an electrical circuit enclosed within the housing for activating an alarm;

an electrical power supply enclosed within the housing for energizing the circuit;

a tack comprising a head and a shank, the shank being adapted to be inserted into the housing of the tag;

a fastener enclosed within the housing for receiving and gripping the tack shank; and means associated with the tag for sensing the presence of the tack head, the sensing means being coupled to energize the alarm-activating circuit from the power supply in response to an output from the sensing means indicative of displacement of the tack head relative to the tag.

5. A security tag for attachment to an article of merchandise, the tag comprising:

a housing;

an electrical circuit enclosed within the housing for activating an alarm;

a source of electrical energy enclosed within the housing for energizing the electrical circuit;

a switch enclosed within the housing for controlling energization of the circuit by the electrical energy source;

means projecting from the housing and operatively associated with the switch for operating the switch;

a tack for attaching the tag to the article, the tack comprising a head and a shank, the shank being adapted to be inserted into the housing of the tag, the switchoperating means being positioned so as to be depressed by the head of the tack when the tack shank is inserted into the housing; and a fastener enclosed within the housing for receiving and gripping the tack shank and resisting withdrawal of the tack from the tag, displacement of the tack head relative to the tag as a result, for example, of an unauthorized attempt to withdraw the tack or sever the tack head releasing the switch-operating means thereby energizing the alarm-activating circuit, the tack being releasable from the fastener by authorized means brought into operative association with the fastener to separate the tag from the article without activating the alarm.

6. A security tag, as set forth in claim 5, in which:

the electrical circuit includes a radio frequency transmitter for radiating an RF signal upon being energized by the electrical energy source.

7. A security tag, as set forth in claim 6, in which:

the radio frequency transmitter includes an encoder for modulating the radiated RF signal in accordance with a predetermined code.

8. A security tag, as set forth in claim 5, in which:

the switch comprises a microswitch having an actuator; and the switch-operating means includes a cam surface engaged by the microswitch actuator whereby travel of the switch-operating means between the depressed and released positions operates the switch.

9. A security tag, as set forth in claim 5, in which:

the electrical circuit further includes a detection circuit tuned to the frequency of an RF surveillance field, the tuned circuit being connected across the switch, resonance of said tuned circuit in the presence of said field causing energization of the alarm-activating circuit.

10. A security tag, as set forth in claim 5, which includes:

a cable having one end affixed to the head of the tack and an other end affixed to the housing, the cable, tack and housing being adapted to form a closed loop for attaching the tag to an article to be protected, the cable including a pair of conductors normally insulated from each other and extending substantially the entire length of the cable, the pair of conductors being connected across the switch, an attempt to cut the cable causing the conductors to come into contact with each other thereby energizing the electrical alarm-activating circuit.

11. A security tag, as set forth in claim 5, in which:

the source of electrical energy includes a battery and the series combination of a capacitor and a resistor connected across the battery whereby the capacitor is charged by said battery through said resistor, the energy stored in said capacitor momentarily energizing the electrical alarm-activating circuit in response to release of the switch operating means.

12. A security tag, as set forth in claim 5, in which:

the electrical circuit includes means for disabling the circuit when the authorized tack releasing means is brought into operative association with the fastener.

13. A security tag for attachment to an article of merchandise, the tag comprising:

a housing;

an electrical circuit enclosed within the housing, the circuit including a source of electrical energy for energizing the circuit and means for activating an alarm;

a tack comprising a head and a shank, the shank being adapted to be inserted into the housing of the tag;

a locking fastener enclosed within the housing for receiving and gripping the tack shank; and a cable having one end affixed to the head of the tack and another end affixed to the housing, the cable, tack and housing being adapted to form a closed loop for attaching the tag to the article to be protected, the cable having electrically conductive means coupled to energize the alarm-activating circuit from said electrical energy source in response to an attempt to sever, or severance of, the cable.

14. A security system for safeguarding articles in a department store or storage facility, comprising:

a plurality of monitoring tags, each tag having means for attaching the tag to an article to be safeguarded, the tag enclosing an electrical circuit including means for detecting tampering with the tag-attaching means;

an RF transmitter energizable in response to tampering with the attaching means; and an encoder for modulating the RF transmission in accordance with a tag-address code applied to the encoder;

a receiver including:

means for detecting a code-modulated RF signal transmitted from a monitoring tag and having an output;

a decoder to the output of the signal-detecting having an address code identical to that of the tag encoder, the decoder having an output for providing a signal when the decoder address code matches that of the tag encoder; and means for activating an alarm in response to the decoder output signal. .

15. A system, as defined in claim 14, in which:

the receiver further includes an encoder coupled to the decoder output, said encoder being encoded with an address code identifying a department or area of said store or facility, the encoder providing an output in response to an output signal from the decoder; and means responsive to said encoder output for indicating an alarm condition.

16. A security tag comprising:

a housing;

means operatively associated with the tag for attaching the tag to an article to be safeguarded;

an electrical switch enclosed within the housing;

a switch actuator projecting from the housing for controlling the switch in response to an attempt to separate the tag from the article;

a radio frequency transmitter enclosed within the housing; and an electrical circuit for energizing the transmitter, the circuit including the switch for controlling energization of the transmitter.

17. A security tag, as set forth in claim 16, in which:

the electrical circuit further includes an encoder for controlling energization of the transmitter in accordance with a predetermined code.

18. A security tag, as set forth in claim 16, in which:

the electrical circuit further includes a detection circuit responsive to an RF surveillance field, the detection circuit being connected across the switch and producing an output in the presence of said field to energize the transmitter.

19. A security tag, as set forth in claim 16, in which:

the attaching means is a tack, the switch actuator sensing the presence of the tack.

20. A security tag, as set forth in claim 16, in which:

the attaching means includes a cable attached to the housing and adapted to form a closed loop for attaching the tag to the article to be protected, the cable including a pair of conductors normally insulated from each other, the pair of cables being connected across the switch, an attempt to cut the cable causing the conductors to come into contact with each other to energize the transmitter.

* * * * *